US008909109B2

(12) United States Patent
Imai et al.

(10) Patent No.: US 8,909,109 B2
(45) Date of Patent: Dec. 9, 2014

(54) DEVELOPING DEVICE HAVING THICKNESS REGULATION BLADE

(71) Applicants: Masashi Imai, Kasugai (JP); Marika Ogiso, Nagoya (JP)

(72) Inventors: Masashi Imai, Kasugai (JP); Marika Ogiso, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/746,804

(22) Filed: Jan. 22, 2013

(65) Prior Publication Data

US 2013/0188997 A1 Jul. 25, 2013

(30) Foreign Application Priority Data

Jan. 23, 2012 (JP) ..... 2012-011393

(51) Int. Cl.
*G03G 15/08* (2006.01)

(52) U.S. Cl.
CPC ..... *G03G 15/0812* (2013.01)
USPC ..... 399/284

(58) Field of Classification Search
CPC ..... G03G 15/09; G03G 15/0812
USPC ..... 399/274, 284
See application file for complete search history.

(56) References Cited

U.S. PATENT DOCUMENTS 6,226,485 B1 * 5/2001 Purizhansky ..... 399/284
6,341,206 B1 1/2002 Yamaguchi et al.
8,014,707 B2 9/2011 Nishiyama et al.
8,129,014 B2 3/2012 Nakamura et al.
2002/0191990 A1 * 12/2002 Hirano et al. ..... 399/279
2009/0169272 A1 7/2009 Nishiyama et al.
2010/0158581 A1 * 6/2010 Mori ..... 399/284
2013/0188998 A1 7/2013 Imai et al.

FOREIGN PATENT DOCUMENTS

JP 11-231647 A 8/1999
JP 2005-242158 A 9/2005
JP 2009-175678 A 8/2009

OTHER PUBLICATIONS

Non-Final Office Action received in corresponding U.S. Appl. No. 13/746,858 mailed May 12, 2014.

* cited by examiner

*Primary Examiner* — Hoang Ngo
(74) *Attorney, Agent, or Firm* — Banner & Witcoff, Ltd.

(57) ABSTRACT

A developing device includes: a casing; a developing roller rotatably supported to the casing; a resiliently deformable blade supported to the casing and extending in an axial direction of the developing roller; and a regulation portion. The developing roller is rotatable in a rotational direction and to carry a layer of developer thereon. The blade has a first surface facing the developing roller. The regulation portion is configured to be in contact with the developing roller to regulate a thickness of the layer of the developer. The blade is formed with a through-hole to allow a material of the regulation portion to pass therethrough to form the regulation portion, the through-hole being exclusively formed in a central area in the axial direction assuming that the blade were divided into three areas each having an identical length in the axial direction with each other.

5 Claims, 5 Drawing Sheets

DEVELOPING DEVICE HAVING THICKNESS REGULATION BLADE

CROSS REFERENCE TO RELATED APPLICATION

This application claims priority from Japanese Patent Application No. 2012-011393 filed Jan. 23, 2012. The entire content of the priority application is incorporated herein by reference.

TECHNICAL FIELD

The present invention relates to a developing device provided with a thickness regulation blade for regulating a thickness of developer.

BACKGROUND

An electrophotographic image forming apparatus uses a developing device having a casing and a developing roller rotatably supported thereto. On a surface of the developing roller, a thin layer of toner having a uniform thickness needs to be formed. To this effect, the developing device is provided with a thickness regulation blade configured to be in contact with the surface of the developing roller for flattening toner provided thereon.

There are two types of thickness regulation blades: "against-type" and "with-type." Assuming that a thickness regulation blade has a base end fixed to the casing of the developing device and a distal end in contact with the surface of the developing roller, the thickness regulation blade is called as "against-type" when a direction from the base end toward the distal end is opposite to a rotation direction of the developing roller; and the thickness regulation blade is called as "with-type" when the direction from the base end toward the distal end is coincident with the rotation direction of the developing roller. There is also known a conventional thickness regulation blade having a portion provided with a regulating portion made of a rubber material, the portion being in contact with the surface of the developing roller.

SUMMARY

Incidentally, in the "against-type" thickness regulation blade, contact pressure against the developing roller can be ensured relatively easy since the distal end of the thickness regulation blade is brought into pressure contact with the surface of the developing roller by friction between the distal end and the developing roller. On the other hand, in the "with-type" thickness regulation blade, contact pressure against the developing roller is harder to be obtained, compared to the "against-type".

In order to form the regulating portion in the "with-type" thickness regulation blade, a through-hole may be formed in a longitudinal end portion of the blade so that a material for forming the regulating portion can be injected through the through-hole to be provided on the blade. However, forming the through-hole in the blade may reduce rigidity of the blade (resiliency of the blade) partially in the vicinity of the through-hole, preventing the toner layer from being formed uniformly on the surface of the developing roller.

It is an object of the present invention is to provide a developing device having a with-type thickness regulation blade that enables a toner layer to be formed uniformly on a surface of a developing roller.

In order to achieve this and other objects of the present invention, there is provided a developing device including: a casing; a developing roller rotatably supported to the casing; a resiliently deformable blade supported to the casing; and a regulation portion. The developing roller defines an axis extending in an axial direction and is configured to rotate in a rotational direction and to carry a layer of developer thereon. The blade extends in the axial direction and has a first surface facing the developing roller. The regulation portion is configured to be in contact with the developing roller to regulate a thickness of the layer of the developer carried on the developing roller. The blade is formed with a through-hole to allow a material of the regulation portion to pass therethrough in order to form the regulation portion on the blade, the through-hole being exclusively formed in a central area in the axial direction assuming that the blade were divided into three areas each having a length in the axial direction equal to each other.

According to another aspect of the present invention, there is provided a developing device including: a casing; a developing roller rotatably supported to the casing; a resiliently deformable blade supported to the casing; a regulation portion; and a reinforcing plate. The developing roller defines an axis extending in an axial direction and is configured to rotate in a rotational direction and to carry a layer of developer thereon. The blade has a first surface facing the developing roller and a second surface opposite to the first surface. The regulation portion is provided on the first surface at a downstream side thereof in the rotational direction, the regulation portion being configured to be in contact with the developing roller to regulate a thickness of the layer of the developer carried on the developing roller. The reinforcing plate is provided on the second surface for reinforcement of the blade. The reinforcing plate includes: a main body portion extending in the axial direction and positioned at an upstream side of the second surface in the rotational direction, the main body portion having axial end portions in the axial direction; and a reinforcing portion extending from each axial end portion toward a downstream side of the second surface in the rotational direction, the reinforcing portion having a length in the axial direction. The blade is formed with a through-hole to allow a material of the regulation portion to pass therethrough in order to form the regulation portion on the blade, the through-hole being exclusively formed within a region having a length in the axial direction identical to the length of the reinforcing portion in the axial direction.

According to still another aspect of the present invention, there is provided a developing device including: a casing; a developing roller rotatably supported to the casing; a resiliently deformable blade supported to the casing; and a regulation portion. The developing roller defines an axis extending in an axial direction and is configured to rotate in a rotational direction and to carry a layer of developer thereon. The blade extends in the axial direction and has a first surface facing the developing roller. The regulation portion is configured to be in contact with the developing roller to regulate a thickness of the layer of the developer carried on the developing roller. The blade is formed with a through-hole and the through-hole is exclusively formed in a central area in the axial direction assuming that the blade were divided into three areas each having a length in the axial direction equal to each other. The regulation portion has a contact portion configured to regulate the thickness of the layer of the developer, and a flat plate portion integral with the contact portion and extending along the first surface and in contact therewith, the flat plate portion having a protruding part protruding into the through-hole.

BRIEF DESCRIPTION OF THE DRAWINGS

The particular features and advantages of the invention as well as other objects will become apparent from the following description taken in connection with the accompanying drawings, in which.

DETAILED DESCRIPTION

An electro-photographic type color LED printer 1 as an example of an image forming apparatus incorporating a developing device according to an embodiment of the present invention will be described with reference to FIGS. 1 to 7.

Figure 1:
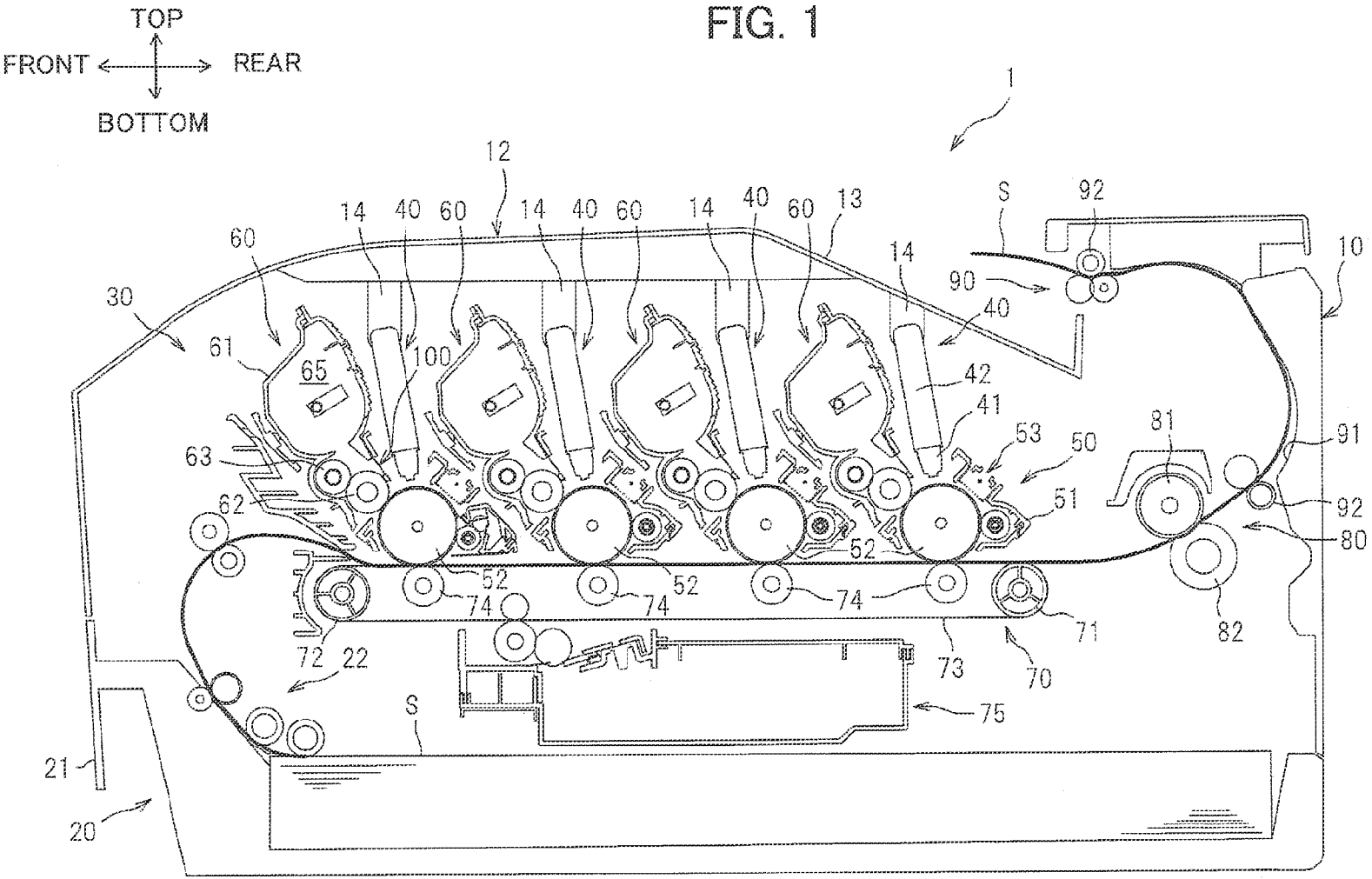
FIG. 1 is a cross-sectional view showing a general configuration of a color LED printer as an image forming apparatus incorporating a developing device according to an embodiment of the present invention.

Throughout the specification, the terms "upward", "downward", "upper", "lower", "above", "below", "beneath", "right", "left", "front", "rear" and the like will be used assuming that the color LED printer 1 is disposed in an orientation in which it is intended to be used. In use, the color LED printer 1 is disposed as shown in FIG. 1. Specifically, in FIG. 1, a left side, a right side, a near side and a far side of the color LED printer 1 are referred to as a front side, a rear side, a right side and a left side, respectively. Further, the top and bottom of the color LED printer 1 will be based on a vertical direction in FIG. 1.

Overall Structure of Color LED Printer

As illustrated in FIG. 1, a color LED printer 1 includes a main casing 10, within which disposed are a sheet supply section 20 configured to supply sheets S, an image forming section 30 configured to form images onto the supplied sheets S, and a sheet discharge section 90 configured to discharge the image-formed sheets S.

An upper cover 12 is provided at an upper end portion of the main casing 10. The upper cover 12 is pivotally movable about a rear side thereof so as to open and close in a vertical direction. The upper cover 12 has an upper surface serving as a sheet discharge tray 13 onto which the sheets S discharged from the main casing 10 is placed. The upper cover 12 has a lower surface on which four holding portions 14 are provided each for pivotally movably supporting an LED unit 40 to be described later.

The sheet supply section 20 is provided at a lower end portion of the main casing 10. The sheet supply section 20 includes a sheet supply tray 21 configured to accommodate a stack of the sheets S, and a sheet supply mechanism 22 configured to supply each sheet S from the sheet supply tray 21 to the image forming section 30. The sheets S accommodated in the sheet supply tray 21 are separated one by one by the sheet supply mechanism 22 and supplied to the image forming section 30.

The image forming section 30 includes four LED units 40, four photosensitive units 50, four developing devices 60, a transfer unit 70, and a fixing unit 80.

The LED units 40 are arranged in a front-rear direction below the upper cover 12. The LED units 40 are disposed to face respective photosensitive drums 52 from above thereof when the upper cover 12 is closed. Each LED unit 40 includes a head portion 41 and a support portion 42 that supports the head portion 41. The head portion 41 has a tip end portion on which a plurality of not-illustrated light-emitting portions (LEDs) is arranged in a left-right direction. The support portion 42 is attached to the upper cover 12 through the corresponding holding portion 14. In the LED unit 40 having the above configuration, the light-emitting portions are configured to blink based on image data so as to expose a surface of a corresponding charged photosensitive drum 52.

The photosensitive units 50 are juxtaposed in the front-rear direction between the upper cover 12 and sheet supply section 20. Each photosensitive unit 50 includes a drum casing 51, a photosensitive drum 52, and a charger 53.

The developing devices 60 are arrayed in the front-rear direction at substantially the same height as the LED units 40 in the vertical direction. The developing units 60 can be attached to/detached from the main casing 10 when the upper cover 12 is opened. Each developing unit 60 includes a casing 61, a developing roller 62, a supply roller 63, a thickness regulation blade 100, and a toner chamber 65 that accommodates toner as an example of developer (also see FIG. 2).

The transfer unit 70 is provided between the sheet supply section 20 and the photosensitive units 50 in the vertical direction. The transfer unit 70 includes a drive roller 71, a follow roller 72, an endless conveying belt 73, four transfer rollers 74, and a cleaning section 75. The endless conveying belt 73 is mounted on the drive roller 71 and the follow roller 72 in a taut state, and has an outer peripheral surface configured to be in contact with each of the photosensitive drums 52. The conveying belt 73 defines an internal space in which the four transfer rollers 74 are disposed such that the conveying belt 73 is nipped between each transfer roller 74 and corresponding photosensitive drum 52.

The fixing unit 80 is disposed rearward of the photosensitive units 50. The fixing unit 80 includes a heat roller 81, and a pressure roller 82 opposing the heat roller 81 so as to apply pressure to the same.

In the image forming section 30, the surface of each photosensitive drum 52 is uniformly charged by the charger 53 and then exposed by the corresponding LED unit 40, thereby an electrostatic latent image being formed on the surface of the photosensitive drum 52 based on image data. The toner in each toner chamber 65 is supplied to the developing roller 62 through the supply roller 63, and then enters between the developing roller 62 and the thickness regulation blade 100 so as to be carried on the developing roller 62 as a thin layer having a constant thickness.

The toner carried on each developing roller 62 is then supplied to the corresponding photosensitive drum 52 on which the electrostatic latent image has been formed to develop the electrostatic latent image into a visible toner image. Thereafter, the sheet S supplied from the sheet supply section 20 is conveyed between each photosensitive drum 52 and the conveying belt 73 (corresponding transfer roller 74), whereby the toner images formed on the respective photosensitive drums 52 are sequentially superimposed onto the sheet S to form a color toner image. The sheet S onto which the color toner image has been formed is then conveyed between the heat roller 81 and the pressure roller 82, whereby the color toner image is thermally fixed onto the sheet S.

The sheet discharge section 90 includes a sheet discharge path 91 and a plurality of conveying rollers 92 configured to convey the sheet S. The sheet discharge path 91 is formed so as to extend upward from an outlet of the fixing unit 80 and turn its direction frontward, and a plurality of conveying rollers 92 that convey the sheet S. The sheet S onto which the toner image has been thermally fixed is conveyed along the sheet discharge path 91 by the conveying rollers 92 and discharged onto the sheet discharge tray 13 outside the main casing 10.

Detailed Configuration of Developing Device

A detailed configuration of the thickness regulation blade 100 and portions adjacent thereto in each developing device 60 will be described. In the following description, directions with respect to the developing unit 60 are different from those defined in FIG. 1. That is, directions with respect to the developing unit 60 (top, bottom, left, right, front, rear) will be referred to as defined in FIG. 3.

Figure 2:
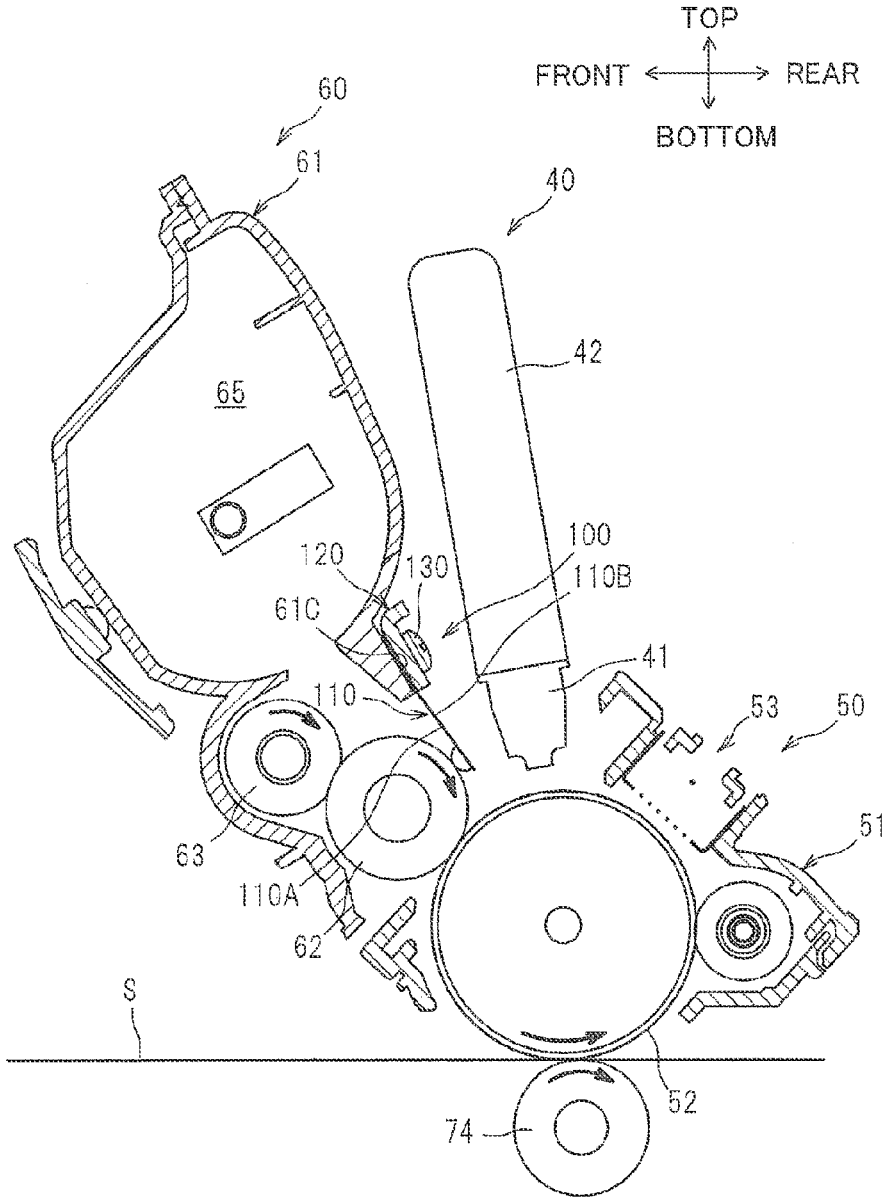
FIG. 2 is an enlarged cross-sectional view of the developing device of FIG. 1 and in the vicinity thereof.
Figure 3:
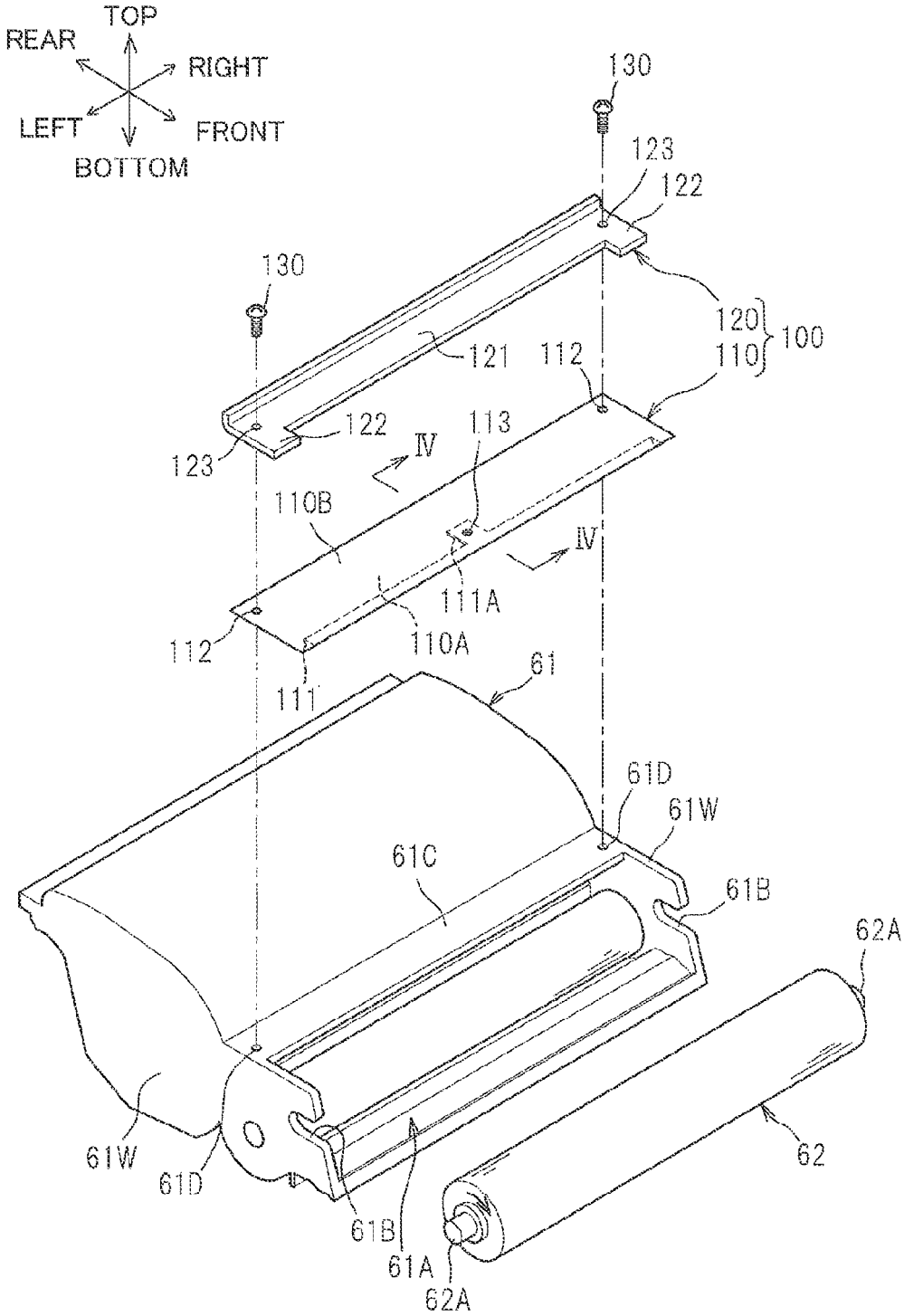
FIG. 3 is an exploded perspective view of the developing device according to the embodiment, the developing device including a thickness regulation blade.

As illustrated in FIG. 3, the casing 61 of the developing device 60 has a front end portion in which an opening 61A is formed. The developing roller 62 is mounted in the casing 61 so as to substantially close the opening 61A (also see FIG. 2). The casing 61 has left and right side walls 61W each having a front end portion in which a groove 61B is formed for supporting the developing roller 62. Further, the casing 61 has an upper wall constituting an upper edge of the opening 61A, and the upper wall has an upper surface 61C serving as a support surface 61C that supports the thickness regulation blade 100. The support surface 61C has left and right end portions in each of which a screw hole 61D is formed for fixing the thickness regulation blade 100 by screws 130.

The developing roller 62 is a roller elongated in the left-right direction and has an outer peripheral surface made of a rubber. The developing roller 62 includes a shaft extending in an axial direction (i.e., left-right direction of the color LED printer 1) and the shaft has both axial ends provided with bearings 62A respectively. The bearings 62A are engaged with the respective grooves 61B of the casing 61 and fixed to the casing 61 by screws (not shown). As a result, the developing roller 62 is rotatably supported by the casing 61. The developing roller 62 is configured to rotate in a clockwise direction in FIGS. 2 and 3.

The thickness regulation blade 100 includes a blade 110 and a reinforcing plate 120.

The blade 110 is formed of a thin metal plate elongated in the axial direction of the developing roller 62. The blade 110 is thus resiliently deformable. The blade 110 has a rear end portion (base end portion) fixed to the support surface 61C of the casing 61, as will be described later.

The blade 110 has an inner surface 110A (first surface) configured to face the developing roller 62, and an outer surface 110B (second surface) opposite to the inner surface 110A.

The inner surface 110A has a front end portion (distal end portion) on which a regulating portion 111 made of a rubber-like material is provided. In other words, the regulating portion 111 is provided at a downstream side of the inner surface 110A in the rotation direction of the developing roller 62. The regulating portion 111 has a substantially semi-circular shape in cross section (see FIG. 2) and extends in the axial direction of the developing roller 62. When the blade 110 is fixed to the casing 61, the regulating portion 111 is configured to contact the outer peripheral surface of the developing roller 62, while the blade 110 is slightly being resiliently deformed, as shown in FIG. 2. Due to the resilient deformation of the blade 110, the regulating portion 111 can contact the outer peripheral surface of the developing roller 62 at a predetermined pressure and spread out (or flatten) the toner retained between the regulating portion 111 and the outer peripheral surface of the developing roller 62, thereby regulating a thickness of the toner layer.

Further, the blade 110 has left and right end portions in each of which a mounting hole 112 is formed at a position corresponding to each of the screw holes 61D.

The reinforcing plate 120 is mounted on the outer surface 110B of the blade 110. The reinforcing plate 120 is formed of a metal plate having a larger thickness and a higher rigidity than the metal plate of the blade 110. As illustrated in FIG. 3, the reinforcing plate 120 includes a main body portion 121 and two reinforcing portions 122. The main body portion 121 extends in the axial direction of the developing roller 62. The main body portion 121 has left and right end portions in each of which a mounting hole 123 is formed at a position corresponding to each screw hole 61D and each mounting hole 112.

Each of the two reinforcing portions 122 extends frontward from each axial end portion of the main body portion 121. That is, each reinforcing portion 122 extends toward downstream in the rotation direction of the developing roller 62.

As illustrated in FIG. 2, the main body portion 121 is disposed on a rear end portion (base end portion) of the outer surface 110B of the blade 110, that is, at an upstream side of the outer surface 110B in the rotation direction of the developing roller 62, when assembled to the casing 61. Hence, the reinforcing plate 120 can bring the base end portion of the blade 110 in close contact with the support surface 61C and reinforce the blade 110 from outward (above) such that the distal end portion of the blade 110 can resiliently deform substantially uniformly in the axial direction of the developing roller 62.

Figure 4:
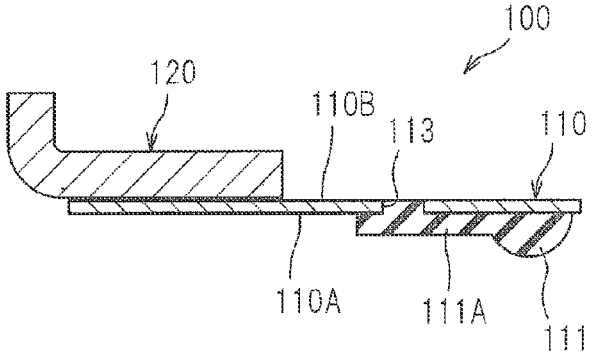
FIG. 4 is a cross-sectional view of the thickness regulation blade according to the embodiment taken along a line IV-IV shown in FIG. 3.

The blade 110 has a central portion in the left-right direction in which a through-hole 113 is formed. More specifically, the through-hole 113 is positioned rearward of the regulating portion 111, but closer to the regulating portion 111 than to the base end portion in the front-rear direction. The through-hole 113 is a hole through which the rubber-like material for forming the regulating portion 111 is adapted to penetrate in order to form of the regulating portion 111. Specifically, as illustrated in FIGS. 3 and 4, the regulating portion 111 is formed with a flat-plate portion 111A extending to cover the through-hole 113. The flat-plate portion 111A extends along the inner surface 110A, and penetrates into the through-hole 113 to fill the same. In a metal die used to form the regulating portion 111 by injection molding, one of cavities serves to form a path connecting between the through-hole 113 and the regulating portion 111. The rubber-like material entering this path and remaining intact after completion of injection molding corresponds to the flat-plate portion 111A.

The above-described blade 110 is assembled with the reinforcing plate 120 and is then fixed to the casing 61 by screwing the screws 130 into the respective screw holes 61D of the casing 61 via the mounting holes 123 and 112.

The developing device 60 according to the present embodiment is attached to the main casing 10 of the color LED printer 1 for use. When a print command is received at the color LED printer 1, the developing roller 62 and the supply roller 63 are rotated to supply the toner from the supply roller 63 to the developing roller 62. The toner entering between the thickness regulation blade 100 and the developing roller 62 is flattened by the regulating portion 111 so as to be borne on the peripheral surface of developing roller 62 as a thin layer.

Inherently, the blade 110 has a higher rigidity at its center portion relative to its both end portions in the axial direction. Therefore, if the through-hole 113 is formed near an axial end portion of the blade 110, rigidity of the axial end portion, which is originally low, may become further lower. As a result, pressing force of the regulating portion 111 near the through-hole 113 against the developing roller 62 would become weaker, thereby making the toner layer on the peripheral surface of the developing roller 62 thicker only in that portion corresponding to and adjacent to the through-hole 113.

However, in the developing device 60 according to the present embodiment, the through-hole 113 is formed on the blade 110 at the central portion in the longitudinal direction thereof (axial direction). Therefore, a reduction in rigidity attributed to formation of the through-hole 113 is not significant. The regulating portion 111 can thus contact the developing roller 62 at a generally uniform pressure in the longitudinal direction, leading to formation of the toner layer having a generally uniform thickness on the developing roller 62.

Figure 5:
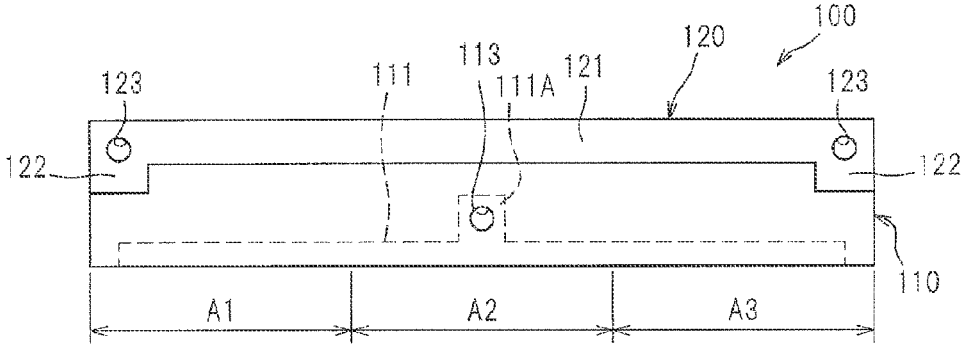
FIG. 5 is a plan view of the thickness regulation blade according to the embodiment.

It should be noted that, the through-hole 113 need not be formed at a position exactly center of the blade 110 in the longitudinal direction thereof. Referring to FIG. 5, assuming that the blade 110 is divided equally into three areas A1, A2 and A3 in the longitudinal direction thereof, the through-hole 113 may be formed at any position within the area A2. As long as the through-hole 113 is formed within the central area A2 on the blade 110, rigidity of the blade 110 is not affected significantly due to the existence of the through-hole 113. Hence, the toner can be carried on the peripheral surface of the developing roller 62 with a generally uniform thickness.

Various modifications are conceivable.

Figure 6:
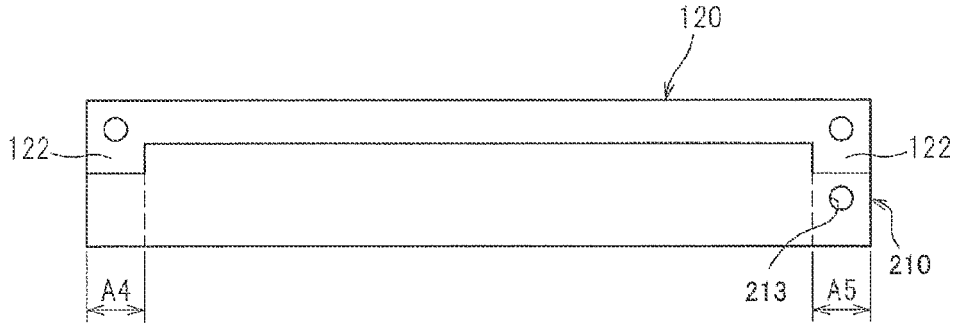
FIG. 6 is a plan view of a thickness regulation blade according to a variation of the present invention.

FIG. 6 shows a through-hole 213 formed on a blade 210 according to a variation of the embodiment. In FIG. 6, regions on the blade 210 each having a length in its longitudinal direction identical to that of each reinforcing portion 122 of the reinforcing plate 120 are labeled as areas A4 and A5, respectively. In this variation, the through-hole 213 may be formed only in the area A4 or in the area A5. Since the both reinforcing portions 122 reinforce the longitudinal end portions of the blade 110, forming the through-hole 213 in the longitudinal end portions of the blade 110 (in the area A4 or A5) could have little impact on the rigidity of the blade 210. Therefore, the toner can be carried on the developing roller 62 as a layer having a generally uniform thickness.

Further, the reinforcing plate 120 may not necessarily have the two reinforcing portions 122. The reinforcing portion 122 may be dispensed with. That is, the reinforcing plate 120 may be configured of the main body portion 121 only.

Examples and Comparative Examples

The inventors of the present invention have conducted several experiments in order to confirm technical advantages of the present invention.

Specifically, the inventors prepared four pairs of the blade 110 formed of a stainless (entire length: 241 mm, width: 18.3 mm, and thickness: 0.1 mm) and the reinforcing plate 120 having a sufficient rigidity. Each blade 110 was attached to a developing device of an existing image forming apparatus (TN-290 manufactured by Brother Industries, Ltd.).

Figure 7:
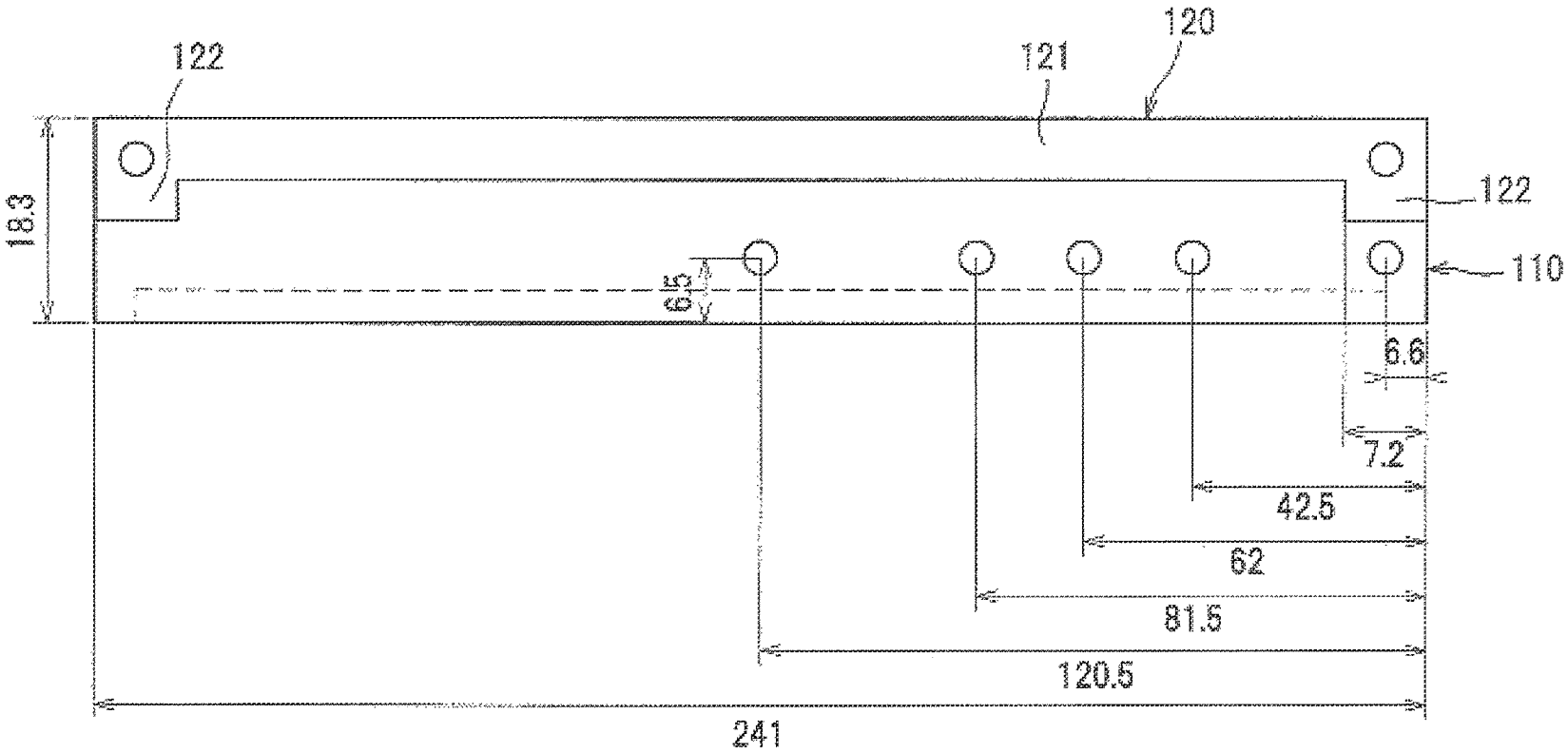
FIG. 7 is a plan view showing positions of through-holes formed as examples of the embodiment and comparative examples thereof.

As shown FIG. 7, in each blade 110, a through-hole having a diameter of 6 mm was formed such that: each through-hole is positioned spaced away from one end of the blade 110 by 120.5 mm, or by 81.5 mm, or by 62 mm, or by 42.5 mm in the longitudinal direction. Each through-hole is spaced away from the tip end of the blade 100 equally by 6.5 mm.

The developing device to which each blade 110 was attached was mounted in the above-identified image forming apparatus and initial operations were performed thereafter. Once the developing device was removed, the inventors visually confirmed the thickness of the toner layer formed by each blade 110. Note that, in the experiments, a portion corresponding to the flat-plate portion 111A was not provided.

Followings results have been discovered from the experiments.

With regard to the through-holes formed at positions separated by 120.5 mm and 81.5 mm from the one end of the blade 110 in the longitudinal direction (formed as examples of the embodiment), the thickness of the toner layer was found to be substantially uniform. However, with regard to the through-holes formed at 62 mm and 42.5 mm from the one end of the blade 110 (formed as comparative examples), the thickness of the toner layer was not uniform: the thickness was increased only at a portion around each through-hole.

The same experiment was conducted for another set of the blade 110 and the reinforcing plate 120 having two reinforcing portions 122. In this experiment, the reinforcing portions 122 were provided at longitudinal end portions of the reinforcing plate 120 respectively and each reinforcing portion 122 has a length of 7.2 mm in the longitudinal direction. The blade 110 was formed with a through-hole having a diameter of 6 mm at a position spaced away from one end of the blade 110 by 6.6 mm in the longitudinal direction. That is, the through-hole is positioned in an area corresponding to one of the reinforcing portions 122 in the longitudinal direction. Obtained results are that, the toner layer has a uniform thickness.

While the invention has been described in detail with reference to the embodiments thereof, it would be apparent to those skilled in the art that various changes and modifications may be made therein without departing from the spirit and scope of the invention.

What is claimed is:

1. A developing device comprising:

a casing;

a developing roller rotatably supported by the casing and defining an axis extending in an axial direction, the developing roller being configured to rotate in a rotational direction and to carry a layer of developer thereon;

a resiliently deformable blade supported by the casing and extending in the axial direction, the blade having a first surface facing the developing roller; and a regulation portion configured to be in contact with the developing roller to regulate a thickness of the layer of the developer carried on the developing roller, wherein the blade is formed with a through-hole to allow a material of the regulation portion to pass therethrough in order to form the regulation portion on the blade, wherein the through-hole is the only through-hole formed in the blade configured to allow the material of the regulation portion to pass therethrough, wherein the through-hole is formed in a central area in the axial direction of the blade, and wherein the central area is a middle of three areas when the blade is divided into the three areas having a length in the axial direction equal to each other.

2. The developing device as claimed in claim 1, wherein the regulation portion is provided on the first surface at a downstream side thereof in the rotational direction.

3. The developing device as claimed in claim 1, wherein the regulation portion has a contact portion configured to regulate the thickness of the layer of the developer, and a flat plate portion integral with the contact portion and extending along the first surface and in contact therewith, the flat plate portion having a protruding part protruding into the through-hole.

4. A developing device comprising:

a casing;

a developing roller rotatably supported by the casing and defining an axis extending in an axial direction, the developing roller being configured to rotate in a rotational direction and to carry a layer of developer thereon;

a resiliently deformable blade supported by the casing and extending in the axial direction, the blade having a first surface facing the developing roller and a second surface opposite to the first surface;

a regulation portion provided on the first surface at a downstream side thereof in the rotational direction, the regulation portion being configured to be in contact with the developing roller to regulate a thickness of the layer of the developer carried on the developing roller; and a reinforcing plate provided on the second surface for reinforcement of the blade, the reinforcing plate including:

a main body portion extending in the axial direction and positioned at an upstream side of the second surface in the rotational direction, the main body portion having a central portion and two axial end portions in the axial direction, wherein the central portion has a downstream edge and is located between the two axial end portions in the axial direction; and a reinforcing portion extending from at least one of the axial end portions toward a downstream side of the second surface in the rotational direction such that the reinforcing portion extends downstream of the downstream edge of the central portion in the rotational direction, the reinforcing portion having a length in the axial direction, wherein the blade is formed with a through-hole to allow a material of the regulation portion to pass therethrough in order to form the regulation portion on the blade, the through-hole being formed within a region having a length in the axial direction identical to the length of the reinforcing portion in the axial direction.

5. A developing device comprising:

a casing;

a developing roller rotatably supported by the casing and defining an axis extending in an axial direction, the developing roller being configured to rotate in a rotational direction and to carry a layer of developer thereon;

a resiliently deformable blade supported by the casing and extending in the axial direction, the blade having a first surface facing the developing roller; and a regulation portion configured to be in contact with the developing roller to regulate a thickness of the layer of the developer carried on the developing roller, wherein the blade is formed with a through-hole to allow a material of the regulation portion to pass therethrough in order to form the regulation portion on the blade, wherein the through-hole is the only through-hole formed in the blade configured to allow the material of the regulation portion to pass therethrough, wherein the through-hole is formed in a central area in the axial direction of the blade, wherein the central area is a middle of three areas when the blade is divided into the three areas having a length in the axial direction equal to each other, and wherein the regulation portion has a contact portion configured to regulate the thickness of the layer of the developer, and a flat plate portion being integral with the contact portion and extending along the first surface and in contact therewith, the flat plate portion having a protruding part protruding into the through-hole.

* * * * *